United States Patent [19]

Carlson

[11] Patent Number: 4,772,407

[45] Date of Patent: Sep. 20, 1988

[54] ELECTRORHEOLOGICAL FLUIDS

[75] Inventor: J. David Carlson, Cary, N.C.

[73] Assignee: Lord Corporation, Erie, Pa.

[21] Appl. No.: 127,448

[22] Filed: Dec. 2, 1987

[51] Int. Cl.[4] ..... C06K 3/00; H01B 3/20

[52] U.S. Cl. ..... 252/74; 192/21.5

[58] Field of Search ..... 252/74; 192/21.5

[56] References Cited

U.S. PATENT DOCUMENTS

| | | | |
|---|---|---|---|
| 2,417,850 | 3/1947 | Winslow | 175/320 |
| 3,047,507 | 7/1962 | Winslow | 252/75 |
| 3,255,853 | 6/1966 | Klass et al. | 192/21.5 |
| 3,367,872 | 2/1968 | Martinek et al. | 252/74 |
| 3,385,793 | 5/1968 | Klass et al. | 252/75 |
| 3,397,147 | 8/1968 | Martinek | 252/78 |
| 3,399,145 | 8/1968 | Martinek et al. | 252/309 |
| 3,412,031 | 11/1968 | Martinek et al. | 252/75 |
| 3,427,247 | 2/1969 | Peck | 252/75 |
| 3,484,162 | 12/1969 | Clark | 355/3 |
| 3,970,573 | 7/1976 | Westhaver | 252/73 |
| 3,984,339 | 10/1976 | Takeo et al. | 252/74 |
| 4,033,892 | 7/1977 | Stangroom | 252/76 |
| 4,129,513 | 12/1978 | Stangroom | 252/78.1 |
| 4,483,788 | 11/1984 | Stangroom et al. | 252/578 |
| 4,502,973 | 3/1985 | Stangroom | 252/73 |
| 4,645,614 | 2/1987 | Goossens et al. | 252/75 |

FOREIGN PATENT DOCUMENTS

| | | |
|---|---|---|
| 0150994 | 1/1985 | European Pat. Off. . |
| 1178301 | 1/1970 | United Kingdom . |
| 2170510 | 8/1986 | United Kingdom . |

OTHER PUBLICATIONS

Influence of Nature of Surfactant on the Electrorheological Effect in Nonaqueous Dispersions; Chertkova et al., pp. 68–74.

Dielectrophoresis—The Behavior of Neutral Matter in Nonuinform Electric Fields; Pohl; pp. 19–33.

Nomadic Polarization in Quasi-One-Dimensional Solids; Pohl, The Journal of Chemical Physics; vol. 66, No. 9, 5-1-77; pp. 4031–4040.

Dielectric Properties of Fluids and Their Relation to Electrorheology; Block et al., IEEE Symposium London, 1985.

Dielectric Properties of Lithium Hydrazinium Sulfate; Schmidt et al.; Physical Review B, vol. 4, No. 12, 12-1-5-71; pp. 4582–4597.

Investigation of Proton-Conducting Solids; Kreuer et al.; Solid State Ionics 3/4 (1981) pp. 353–358.

Characteristics of Charge Transfer in the Dispersed Phase of Electrorheological Suspensions; Makatun et al., Royal Aircraft Establishment Translation 2125, Fnzh.-Fiz. Zh., 45,4, pp. 597–602 (1983).

*Primary Examiner*—Robert Wax

*Attorney, Agent, or Firm*—Bell, Seltzer, Park & Gibson

[57] ABSTRACT

The present invention is a fluid which exhibits excellent electrorheological properties at low current densities, at high temperatures, and in the complete absence of absorbed water or water of hydration. In a preferred embodiment, the fluid comprises lithium hydrazinium sulfate dispersed in silicone oil, and in the presence of an appropriate suspension stabilizing agent.

28 Claims, 1 Drawing Sheet

Induced yield stress versus electric field for Example 1

Current density versus electric field for Example 1

ELECTRORHEOLOGICAL FLUIDS

FIELD OF THE INVENTION

The present invention relates to fluid compositions which demonstrate significant changes in their fluid properties in the presence of an electric field.

BACKGROUND OF THE INVENTION

Fluids which exhibit significant change in their properties of flow in the presence of an electric field have been known for several decades. Such fluids were first referred to as "electroviscous" because their apparent viscosity changes in the presence of electric fields. As understanding of these types of fluids has grown, it has now become apparent that the phenomena being observed is a change in the minimum stress required to induce shear in the fluid, while the actual viscosity may remain generally constant. Accordingly, these effects are better understood in terms of the total rheology of the fluids and such compositions are now more commonly referred to as "electrorheological" ("ER") fluids.

Early studies of electrorheological fluids were performed by W. M. Winslow, some of which are reported in U.S. Pat. Nos. 2,417,850 and 3,047,507. Winslow demonstrated that certain suspensions of solids (the "discrete," "dispersed" or "discontinuous" phase) in liquids (the "continuous" phase) show large, reversible electrorheological effects. These effects are generally as follows: In the absence of an electric field, electrorheological fluids exhibit Newtonian behavior; specifically, their shear stress (applied force per unit area) is directly proportioned to the shear rate (relative velocity per unit thickness). When an electric field is applied, a yield stress phenomenom appears and no shearing takes place until the shear stress exceeds a yield value which rises with increasing electric field strength. This phenomenon can appear as an increase in apparent viscosity of several, and indeed many, orders of magnitude.

In laymen's terms, an ER fluid initially appears as a liquid which, when an electric field is applied, acts almost as if it had become a solid.

Electrorheological fluids change their characteristics very rapidly when electric fields are applied or released, with typical response times being on the order of one millisecond. The ability of ER fluids to respond rapidly to electrical signals gives them unique characteristics as elements in mechanical devices. Often, the frequency range of a mechanical device can be greatly expanded by using an ER fluid element rather than an electromechanical element having a response time which is limited by the inertia of moving mechanical parts. Therefore, electrorheological fluids offer important advantages in a variety of mechanical systems, particularly those which require a rapid response interface between electronic controls and mechanical devices.

All sorts of devices have been proposed to take advantage of the electrorheological effect. Because of their potential for providing a rapid response interface between electronic controls and mechanical devices, these fluids have been applied to a variety of mechanical systems such as electromechanical clutches, fluid filled engine mounts, high speed valves with no moving parts, and active dampers for vibration control among others.

A rather wide variety of combinations of liquids and suspended solids can demonstrate electrorheological effects. As presently best theorized, the basic requirements for an ER fluid are fine dielectric particles, the surface of which typically contains adsorbed water or some other surfactant or both, suspended in a non-polar dielectric fluid having a permittivity less than that of the particle and a high breakdown strength. As used herein, the term "dielectric" refers to substances having very low electrical conductivities. Such substances have conductivities of less than $1\times10^{-6}$ mho per centimeter. These are rather general requirements, and accordingly a wide variety of systems have been found to demonstrate ER effects. Winslow's initial work was performed using materials as simple as starch in mineral oil. As analysis of these materials has continued, other materials have been investigated, with common ones being silica and silicone oils as the discrete and continuous phases, respectively.

There are a number of proposed hypotheses for explaining the mechanism through which electrorheological fluids exhibit their particular behavior. All of these center around the observation that the electrorheological effect appears in suspensions in which the permittivity of the discrete phase particles is greater than that of the continuous phase. A first theory is that the applied electric field restricts the freedom of particles to rotate, thus changing their bulk behavior. A second theory describes the change in properties to the formation of filament-like aggregates which form along the lines of the applied electric field. One present theory proposes that this "induced fibration" results from small lateral migrations of particles to regions of high field intensity between gaps of incomplete chains of particles, followed by mutual attraction of the particles.

A third theory refers to the "electric double layer" in which the effect is explained by hypothesizing that the application of an electric field causes a layer of materials adsorbed upon the discrete phase particles to move, relative to the particles, in a direction along the field toward the electrode having a charge opposite that of the mobile ions in the adsorbed layer. As used herein, the term adsorption refers to the adherence of the atoms, ions or molecules of a gas or liquid to the surface of another substance which is referred to as the adsorbent. This differs from absorption which refers to the penetration of one substance into the inner structure of another.

Yet another theory proposes that the electric field drives water to the surface of the discrete phase particles through a process of electro-osmosis. The resulting water film on the particles then acts as a glue which holds the particles together.

As demonstrated by this wide variety of proposed theories, there exists no single clear cut explanation of all of the observed phenomena. Nevertheless, a number of empirical parameters have been identified which tend to increase or decrease the electrorheological effect in any given fluid. These can be briefly summarized as follows:

Particle size and concentration: In general, higher volume fractions of the dispersed phase afford higher induced yield stresses at constant field strength and shear rate conditions. Some researchers have found it advantageous to use smaller particles, while others have argued that a distribution of particle sizes is desirable. Yet another has concluded that electrorheological effects of a fluid will increase with an increase in particle diameter until a certain size is reached which maximizes the effect, after which a further increase in the size of the particles causes a decrease in the effect. Alternatively, for a given size particle, the electrorheological effects of the fluid will increase linearly with concentration of particles until a maximum value is reached, after which the effect again begins to fall off.

Particle porosity and adsorbed moisture: Some researchers have postulated that the dispersed particles should be sufficiently porous to be capable of adsorbing at least 10 percent by weight of water, and that the adsorption of water on the particles is a prerequisite to the electrorheological effect in a fluid. Although it has been determined that adsorbed water is not always a prerequisite for the electrorheological effect, adsorbed water does have a marked effect on producing electrorheological effects in a great many cases. Overly large amounts of water, however, increase the electrical conductivity of electrorheological fluids and the resulting amount of current required to produce the effect increases exponentially with an increase in water content.

Surface activators and surfactants: In many electrorheological fluids, suspension stabilizers such as surface activators or surfactants demonstrate an increase in the electrorheological response of the fluid, or assist in keeping the solid particles from settling, or both.

Field strength: Electrorheological effects increase with increasing field strength. In studying applied fields, it has been determined that constant applied field strengths at different electrode spacings result in about the same electrorheological behavior, demonstrating that the electrorheological properties of a given fluid are bulk properties of the system, rather than "wall effects" or other geometric factors.

Temperature: The viscosity of electrorheological fluids has been observed to increase with increasing temperature under an electric field, and under a given set of conditions the relative viscosity is higher at higher temperatures. The resistivity of electrorheological fluids, however, has been found to decrease as temperature increases. For example, in water-activated systems the current which will be passed by an electrorheological fluid at a fixed voltage field generally doubles for each rise in temperature of 6° C.

Shear rate: The shear stress of electrorheological fluids increases slightly with shear rate, but not as quickly as shear stress rises in the absence of a field. Accordingly, the "electroviscosity" (the arithmetic difference between apparent viscosity and viscosity in the absence of a field) decreases with increasing shear rate.

A large number of other factors can be shown to have greater or lesser effects on the behavior and response of electrorheological fluids. The basic relationships, however, can be summarized as follows: when only one parameter is varied, electrorheological effects increase with an increasing volume fraction of the dispersed phase, with an increase in field strength, and with an increase in temperature. The effects decrease with increasing shear rate.

Turning to more specific applications, in order to fulfill their potential as a unique interface between electronic controls and mechanical systems, appropriate electrorheological fluids must demonstrate certain practical characteristics. For example, for certain applications an ER fluid should be able to withstand relatively high operating temperatures. Under other circumstances, low power consumption is important. In yet other circumstances, the dispersed phase particles must be non-abrasive. In other circumstances, the dispersed phase must remain dispersed even where some sort of dispersing agitation cannot be provided. As would be expected, the chemical nature of the continuous liquid, the dispersed solid, and any resulting combination should be compatible with the mechanical materials used to produce the electrorheological device.

Many electrorheological devices are more desirably operated at relatively high operating temperatures and low electric field strengths. Such conditions can be less suitable for inducing the electrorheological effect in fluids which rely on water adsorption as part of their electrorheological mechanism, because of the thermal and electrical properties of water. Nevertheless, any electrorheological fluid used in such devices must still demonstrate sufficient electrorheological capabilities as to be useful.

Therefore, there exists a present need for ER fluids which are suitable for use under high temperature and low current conditions, i.e. a material with an appropriately low conductivity, and yet which are physically, mechanically, and chemically compatable with applied systems.

Several systems have already been proposed. Chertkova et al, *Kolloidnyi Zhurnal,* Vol. 44, No. 1, pp. 83–90, Jan–Feb 1982, discuss the electrorheological behavior of titanium dioxide ($TiO_2$) dispersions in dielectric fluids to which ten different surfactants were added, but from which water was absent. Because $TiO_2$ is a semiconductor, however, ER fluids produced according to Chertkova's description could require higher current usage than is desirable for many practical applications.

Makatun et al, *Inzh.-Fiz. Zh.,* 45, 4, 597–602 (1983) (available as library translation 2125 from the Royal Aircraft Establishment) discuss the behavior of several ER fluids, using aluminum dihydrotripolyphosphate ($H_2AlP_3O_{10}.2H_2O$) as a primary example for the dispersed particulate phase. Although Makatun does not discuss adsorbed water as being necessary to such systems, he reports that the hydrated character of the compound contributes to the ER effect. Therefore, because $H_2Al_3O_{10}.2H_2O$ will dehydrate at temperatures of about 130° C. and above, Makatun's compositions would be expected to lose their ER effectiveness in applications taking place at such temperatures.

In another example, Block and Kelly (U.K. Patent Application GB No. 2 170 510 A, Aug. 6, 1986) describe an ER fluid which is effective using an anhydrous dispersed phase. Block and Kelly recognize some of the disadvantages of water-activated ER fluids, but like Cherthova et al suggest that semiconductors—and preferably organic semiconductors—be used as the dispersed phase material. The materials they suggest are generally pigments and tend to form messy fluids which are difficult to handle. Additionally, because the dispersed phase materials are semiconductors, the current densities and power consumption required by the Block and Kelly fluids can be as high as in water-activated systems. This, of course, makes the use of such materials disadvantageous, if not impossible, in applications calling for low current density.

Accordingly, it is an object of the present invention to provide an electrorheological fluid which will demonstrate appropriate electrorheological capabilities in the absence of water.

It is another object of the present invention to provide an electrorheological fluid which exhibits appropriate capabilities in the absence of water and at relatively low current densities.

It is a further object of this invention to provide an improved electrorheological fluid in which the dispersed phase is sufficiently polarizable to give rise to the electrorheological effect, while having a sufficiently low conductivity to prevent electric discharge or excessive current densities while in use.

It is a further object of this invention to provide an electrorheological fluid in which the dispersed phase is a hyperprotonic conductor.

It is another object of this invention to provide an electrorheological fluid in which the properties of polarizability and low conductivity are provided by a dispersed phase solid crystalline material which conducts electricity favorably along only one of the three crystal axes.

It is a further object of the invention to provide a method of preparing an electrorheological fluid which is effective at low current densities and in the absence of adsorbed water or water of hydration by admixing a dielectric liquid with a particulate phase formed from a crystalline material which conducts current only along one of the three crystal axes to form a suspension of the crystalline material in the dielectric liquid.

The foregoing and other objects, advantages and features of the invention, and the manner in which the same are accomplished will become more readily apparent upon consideration of the following detailed description of the invention taken in conjunction with the accompanying drawings, which illustrate preferred and exemplary embodiments, and wherein:

SUMMARY OF THE INVENTION

Figure 1:
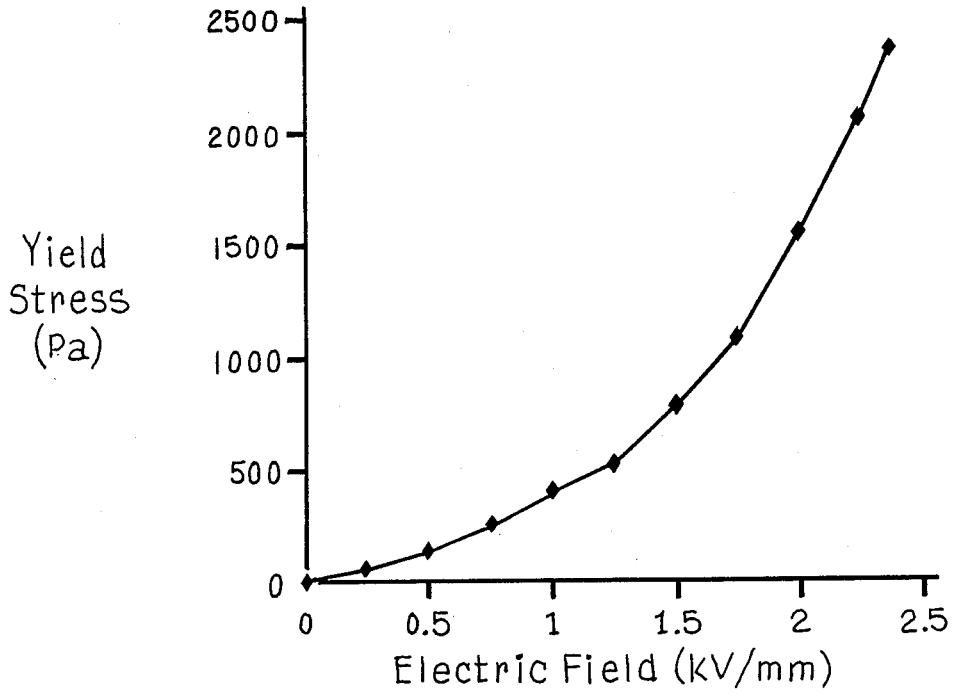
FIG. 1 is a graph plotting yield strength in pascals against electric field in kilovolts per millimeter for a preferred ER fluid according to the present invention.

The present invention is a fluid which exhibits excellent electrorheological properties at low current densities, at high temperatures, and in the complete absence of adsorbed water or water of hydration. The fluid comprises a suspension of a liquid phase formed of a dielectric liquid and a dispersed particulate phase formed from a crystalline material which conducts current only along one of the three crystal axes.

DETAILED DESCRIPTION

The present invention comprises an electrorheological fluid having electrorheological properties at low current densities and in the absence of water. The fluid comprises a liquid phase formed of an appropriate dielectric liquid and a dispersed particulate phase formed of a polarizable solid material. The particulate phase is characterized as being one-dimensional in its conductivity—i.e. one which conducts current substantially along only one of the three crystal axes—the exemplary choice of which is lithium hydrazinium sulfate ($LiN_2H_5SO_4$), which in turn has the additional characteristics of being hyperprotonic and exhibiting nomadic conduction. Other such one-dimensional conductive materials will be available to those skilled in the art.

Unlike most electrorheological fluids, the invention develops a large, electric field induced yield stress in the absence of either adsorbed water on the surface of the particles or water of hydration present as part of the crystal structure. As set forth earlier, most electrorheological fluids are water activated and their electrorheological response diminishes greatly or disappears entirely when they are dried, or raised to elevated temperatures, characteristics which limit their useful operating applications.

Lithium hydrazinium sulfate is an unusual material, and its use in an electrorheological fluid is novel. Lithium hydrazinium sulfate displays an enormous anisotropic dielectric constant; i.e. its conductivity varies from axis to axis within the crystal structure. Lithium hydrazinium sulfate displays its anisotropic dielectric constant over a very broad temperature and frequently range but maintains low conductivity at low frequencies. Studies of lithium hydrazinium sulfate indicate that the irregular or unusual dielectric behavior of this compound is the result of nearly one-dimensional protonic conductivity and of the sensitivity of its conduction characteristics to barriers caused by local crystal defects. According to one researcher, the crystal structure of lithium hydrazinium sulfate is such that a framework of $SO_4$ and $LiO_4$ tetrahedra form channels parallel to one axis in which hydrazinium ($N_2H_5^{+1}$) ions are located; Kreuer et al, *Investigation of Proton-Conducting Solids,* Solid State Ionics ¾ (1981) 353–358.

As used herein, hyperprotonic conduction refers to a given material's characteristic of conducting current through the movement of protons rather than the movement of electrons or holes. "Holes" are empty electron energy states that are present in a crystal as a result of "foreign" atoms or lattice imperfections. Because electrons are mobile, holes can migrate in a manner similar to electrons. In contrast, in lithium hydrazinium sulfate, protons may attach to molecular "vehicles" to form ions like $N_2H_5^{+1}$ which in turn are mobile as a whole, Kreuer, supra. As a result, lithium hydrazinium sulfate is easily polarizable, a desirable characteristic for the particulate phase of an electrorheological fluid, but has a low conductivity, another desirable characteristic for the particulate phase of an electrorheological fluid. It will be understood, however, that the electrorheological fluid of the present invention is novel in its characteristics and applications regardless of any current understanding of the underlying atomic and molecular phenomena.

Accordingly, it has been discovered according to the present invention that electrorheological fluids which include lithium hydrazinium sulfate as the dispersed phase display outstanding electrorheological properties in the absence of any adsorbed water or water of hydration and at current densities which are one or more orders of magnitude lower than those required by other electrorheological fluids designed to operate under anhydrous conditions.

The hyperprotonic polarization exhibited by lithium hydrazinium sulfate can also be considered to be a special case of nomadic polarization. Nomadic polarization results from the pliant response of thermally excited charges situated on long polymer chains or crystal lattice domains. The term "nomadic" is descriptive of the movement of the charges in response to an external electric field, which movement is relatively wide-ranging; i.e. over distances corresponding to many molecular lengths or lattice sites. In contrast, the charged displacements in normal electronic (movement of electrons or holes), atomic or orientational polarization are quite small.

Most nomadic polarization results from highly delocalized electrons moving on long molecular (polymeric) domains and is referred to as "hyperelectronic" polarization. Lithium hydrazinium sulfate is unusual in that the charge carriers which provide its nomadic polarization characteristics are protons which are free to roam for considerable distances along one particular axis in the crystal structure as described earlier. Accordingly, this characteristic is known as "hyperprotonic" polarization.

The large dielectric constant of lithium hydrazinium sulfate reflects the high polarizability of its crystals. Accordingly, when an electrorheological fluid is formed using lithium hydrazinium sulfate as the dispersed particulate phase, a very large induced yield stress occurs under the influence of an external electric field. In short, such a fluid gives a very strong electrorheological response. At the same time, the low, anisotropic conductivity at low frequencies allows the applied current and the resulting power consumption of such a fluid to remain desirably small.

Chemically, because lithium hydrazinium sulfate is a salt, it is very stable under most conditions and has a melting point greater than 300° C. In contrast to Kreuer et al, who report a loss of hydrazinium at temperatures above 80° centigrade, electrorheological fluids according to the present invention are capable of operating at very high temperatures, typically almost 200° C. higher than materials which are effective only in the presence of adsorbed water or water of hydration.

Crystals of lithium hydrazinium sulfate can be synthesized by combining stoichiometric amounts of lithium carbonate and hydrazine sulfate according to the following reaction:

$$Li_2CO_3+2(NH_2)_2H_2SO_4 \rightarrow 2LiN_2H_5SO_4+CO_2+H_2O$$

In practice, the hydrazine sulfate powder is first partially dissolved in distilled water. The lithium carbonate powder is added slowly while stirring the water. The reaction generates bubbles of carbon dioxide gas rather profusely as the reaction proceeds. When the reaction is complete, water is allowed to evaporate. The resulting crystalline lithium hydrazinium sulfate is crushed, ground and dried. In preferred embodiments, the crystals are ground to yield a fine powder of between about one and about twenty microns in size with sizes of between about five and ten microns preferred. The powder is then stored in a convection oven at about 115° C. to prevent any water adsorption or caking until it is used to form the electrorheological fluid.

The electrorheological fluid itself can be prepared by simply mixing the lithium hydrazinium sulfate powder with an appropriate amount of a dielectric liquid, typically a silicone oil. In one embodiment, the lithium hydrazinium sulfate is added until it is present in a volume fraction of the total fluid of between about 15 and about 50 percent. In another preferred embodiment, the amount of lithium hydrazinium sulfate is present in a ratio by weight of between about 1:1 and about 1.7:1, lithium hydrazinium sulfate to silicone oil.

It has been determined according to the present invention, however, that although the initial mixing of appropriate proportions of the lithium hydrazinium sulfate powder and the silicone oil results in a working ER fluid, the dispersed lithium hydrazinium sulfate tends to flocculate, making the fluid form a thick grease or paste. The physical characteristics of such a grease or paste can be disadvantageous in certain applications. Accordingly, under other applications a suspension stabilizer is added to the mixture of lithium hydrazinium sulfate and silicone oil.

A first type of stabilizer is referred to as a "steric" stabilizer, meaning that the molecular structure of the stabilizer is such that when present with the lithium hydrazinium sulfate, the stabilizer retards or eliminates the tendency of the lithium hydrazinium sulfate particles to thicken or settle. One preferred steric stabilizer is an amino-functionalized polydimethylsiloxane. This material acts as a fluidizer which prevents the uncontrolled flocculation of the lithium hydrazinium particles, and results in an electrorheological fluid that has a consistency similar to that of milk. Preferably, this dispersant can be added to, and dissolved in, the silicone oil before the lithium hydrazinium sulfate powder is added.

Even more advantageously, it has been determined according to the present invention, that when added in proper proportions the steric stabilizer does not totally stabilize the lithium hydrazinium sulfate particles but instead allows a controlled amount of weak flocculation to take place. This aspect of weak flocculation keeps the relatively dense lithium hydrazinium sulfate particles in a desired suspension.

By way of further explanation, the lithium hydrazinium sulfate particles have a specific gravity of about 2.0, which is slightly more than twice that of the silicone oil. Because the particles are too large for Brownian motion to keep them suspended, individual lithium hydrazinium sulfate particles are gravitationally unstable when suspended in the silicone oil. If the suspension stabilizer totally stabilized the particles and prevented any flocculation whatsoever, a very dense sediment would result as the particles rolled over and past one another until the closest possible packing density was reached. If, however, the system is slightly unstable, weak flocculation takes place, forming a loose network of flocculated particles which results in a "sediment" volume large enough to fill the entire suspension. This effectively results in the formation of a gel. As used herein, the term "gel" refers to the condition in which the dispersed particles are combined with the liquid continuous phase to form submicroscopic particle groups which retain a great deal of solvent in the interstices therebetween.

In the absence of the stabilizer, and as stated above, the lithium hydrazinium sulfate particles form a rather heavy flocculated grease. In contrast, the weakly flocculated suspension resulting from the stabilizer becomes fluid when moderately shaken or stirred as a sufficient number of bonds between particles are broken. If left undisturbed for a period of time, however, the fluid will return to the gel state. This characteristic is referred to as thixotropy, which is defined as the ability of certain gels to liquify when agitated and then to return to the gel form when at rest.

As a further example, thixotropy is a desirable property in higher quality paints.

It has been determined according to the present invention that the production of a thixotropic fluid depends strongly upon the type and amount of steric stabilizer present. If the fluid lacks stabilizer, a permanent paste results. If too much stabilizer is added, the particles are free to settle into a dense sediment. In preferred embodiments of the invention, an amino-functionalized polydimethylsiloxane steric stabilizer having a molecular weight of about 5,000 is added to the fluid in amounts between about 0.05 percent and 0.3 percent by weight relative to lithium hydrazinium sulfate. One currently available such stabilizer is Baysilone OF-4061 which is available in the United States from Mobay, a distributor for Bayer of Germany. In a most preferred embodiment, the stabilizer is added in amounts of between about 0.1 percent and 0.2 percent by weight relative to the lithium hydrazinium sulfate. Generally speaking, if the resulting fluid is to be used in applications calling for relatively high temperatures; e.g. greater than 100° C., dispersant amounts in the upper end of these ranges are preferred.

If the amount of stabilizer is increased significantly, a sediment layer and a clear layer will form, resulting from the particles being too stabilized to flocculate at all. In a preferred embodiment, a volume mixture of one part lithium hydrazinium sulfate and one part of ten centistoke silicone oil, along with the appropriate amount of stabilizer as set forth above, forms a thixotropic gel in approximately one hour. A vial containing a few milliliters of this fluid can be inverted and the fluid will not run out. The fluid will remain in this condition indefinitely with no settling or phase separation occurring. Nevertheless, a small agitation, such as a single, light finger tap, is sufficient to refluidize the suspension.

Other steric stabilizers may be used as dispersants and include amino-, hydroxy-, acetoxy-, or alkoxy-functionalized polydimethylsiloxanes having molecular weights in excess of 800, or more specifically, between about 10 and about 1000 repeat units in the polysiloxane chain. Other suitable steric stabilizers include the wide range of block and graft copolymers as described by D. H. Napper in "Polymeric Stabilization of Colloidal Dispersions", Academic Press, London, 1983. These include materials originally pioneered by D. W. J. Osmond and co-workers at ICI and the polymeric dispersants currently available under the trade name HYPERMER from ICI.

Block copolymers are molecules in which two different types of homopolymer chains ( . . . AAAAAAAA . . . and . . . BBBBBBB . . . ) are joined end to end. While any number of homopolymer blocks can be joined together, typically only one block of each type are involved so that the final copolymer has one end of type A and the other end of type B (AAAAAAAAAABBBBBBBBBBBB). In the case of a block copolymer stabilizer, one block forms an anchor group which is nominally insoluble in the fluid media and attaches to the particle surface. The other block is soluble in the fluid, will generally be very long and provides the steric stabilization barrier. Graft copolymers are somewhat different. In this case a long polymeric backbone is formed by one of the homopolymers with side chains of the other homopolymer attached at intervals along its length to form a comb-like copolymer structure:

```
. . . AAAAAAAAAAAAAAAAAAAAAAAA . . .
        B                B
        B                B
        B                B
        B                B
        B                B
        B                B
        .                .
```

-continued

In this case the polymer backbone would form the anchor for attaching the molecule to the particle and the side chains would be solvated by the fluid media.

Typical combinations of anchor groups and barrier groups are given by Napper, supra p. 29, in Table 2.3 which for convenience is included here as Table I:

TABLE I

Typical stabilizing moieties and anchor polymers for sterically stabilized dispersions

| Anchor polymer | Stabilizing moieties |
|---|---|
| Aqueous dispersions | |
| polystyrene | poly(oxyethylene) |
| poly(vinyl acetate) | poly(vinyl alcohol) |
| poly(methyl methacrylate) | poly(acrylic acid) |
| poly(acrylonitrile) | poly(methacrylic acid) |
| poly(dimethylsiloxane) | poly(acrylamide) |
| poly(vinyl chloride) | poly(vinyl pyrrolidone) |
| poly(ethylene) | poly(ethylene imine) |
| poly(propylene) | poly(vinyl methyl ether) |
| poly(lauryl methacrylate) | poly(4-vinylpyridine) |
| Nonaqueous dispersions | |
| poly(acrylonitrile) | polystyrene |
| poly(oxyethylene) | poly(lauryl methacrylate) |
| poly(ethylene) | poly(12-hydroxystearic acid) |
| poly(propylene) | poly(dimethylsiloxane) |
| poly(vinyl chloride) | poly(isobutylene) |
| poly(methyl methacrylate) | cis-1:4-poly(isoprene) |
| poly(acrylamide) | poly(vinyl acetate) |
| | poly(methyl methacrylate) |
| | poly(vinyl methyl ether) |

Typical of the Hypermer polymers from ICI are block copolymers of poly(ethylene oxide) and poly(propylene oxide) along with others, including the folowing specific examples:

Definitions $(PO)_m$ is poly(proylene oxide)

$(EO)_n$ is poly(ethylene oxide)

$(PO)_m(EO)_n$ is a poly(propylene oxide)/poly(ethylene oxide) block copolymer n-Bu is n-butyl R is an alkyl or alkenyl radical group Examples

1.

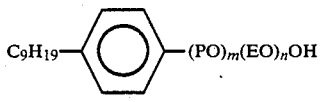

2. n-Bu$(PO)_m(EO)_n$OH

3. HO$(EO)_n(PO)_m(EO)_n$OH

4.

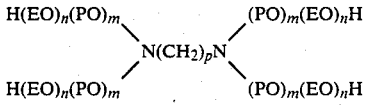

5. alkyl-phenol-formaldehyde novolac resin alkoxylate

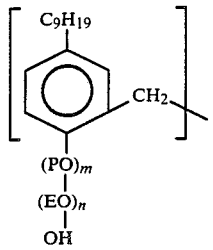

6. $(C_6H_{13}CH(OH)C_{10}H_{20}COOH)_n[H(EO)_mOH]$ poly(12-hydroxystearic acid)/polyethylene glycol copolymer
7. polymethylmethacrylate-polyethylene glycol copolymer

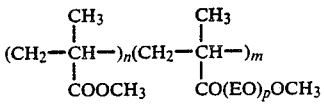

8. polyalkenylsuccinic acid-polyethylene glycol copolymer

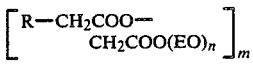

9. polyethylene glycol-alkyd resins.

The optimal amount of stabilizer will depend on the actual surface area of the particles and the molecular weight of the specific stabilizer (surfactant, dispersant) selected. The surface area of lithium hydrazinium sulfate particles prepared as described herein has been estimated from microscopic analyses and analysis of nitrogen adsorption isotherms to be about 1 $m^2$/gram. Based upon this surface area, the preferred amounts of the Baysilone OF-4061 stabilizer referred to above corresponds to between about 0.05 and about 1 molecules of stabilizer per square nanometer of lithium hydrazinium sulfate surface, with about 0.16 molecules per square nanometer preferred; i.e. $1.6\times10^{17}$ molecules per square meter.

As an additional consideration in forming suspension-stabilized ER fluids suitable for higher-temperature applications, it has been discovered according to the present invention that maintaining or "aging" the fluid at an elevated temperature—typically more than 100° centigrade—encourages the thixotropic gel to form irreversibly. Because higher operating temperatures tend to require ER fluids carrying higher proportions of suspension stabilizer, the heated aging of the fluids of the present invention forms fluids that are predictably stable at the higher operating temperatures.

Although silicone oils having viscosities of between about 0.65 and 1000 centistokes are preferred, the continuous liquid phase of the electrorheological fluids of the present invention can be selected from any one of a large number of electrically insulating, hydrophobic liquids. These include mineral oils, transformer oils, transformer insulating fluids, paraffin oils, halogenated aromatic liquids and halogenated paraffins. As known to those familiar with such compounds, transformer oils refer to those liquids having characteristics properties of both electrical and thermal insulation. Naturally occurring transformer oils include refined mineral oils which have low viscosity and high chemical stability. Synthetic transformer oils generally comprise chlorinated aromatics (chlorinated biphenyls and trichlorobenzene) which are known collectively as "askarels"; silicone oils; and esteric liquids such as dibutyl sebacate.

One class of fluids that has been found to be particularly useful in conjunction with the present invention are certain perfluorinated polyethers and related derivatives which are currently sold under the trade names of FOMBLIN and GALDEN by the Montedison Group and the FLUORINERT liquids sold by 3M.

Evaluation of the properties and characteristics of the electrorheological fluids of the present invention, as well as other ER fluids, can be carried out by directing the fluids through a defined channel, the sides of which form parallel electrodes with definite spacing therebetween. A pressure transducer measures the pressure drop between the entry and exit ends of the flow channel as a function of applied voltage. By keeping flow rates low, the viscous contribution to the pressure drop is kept negligible. Induced yield stress (T) is calculated according to the following formula:

$$T=dp(B/2L)$$

where dp represents the pressure drop, L is the length of the channel and B is the electrode spacing. The numerical constant 2 is generally valid for the normally encountered ranges of flow rates, viscosities, yield stresses and flow channel sizes. In its strictest sense, this constant can have a value between 2 and 3, a detailed discussion of which is given in R. W. Phillips "Engineering Applications of Fluids With a Variable Yield Stress," Ph.D. Thesis, University of California, Berkley, 1969.

EXAMPLE I

This fluid comprised 100 parts of lithium hydrazinium sulfate powder prepared as described above, having a particle size of between about 5 and about 10 microns, and dispersed in 59 parts of 10 centistoke silicone oil with 0.13 parts of Baysilone OF-4061 added. Upon standing quiesent for approximately one hour, this fluid formed a weak gel and did not settle into a hard sediment. The yield stress results are illustrated in FIGS. 1 and 2.

FIG. 1 shows the induced yield stress as a function of electric field for the fluid of Example 1.

Figure 2:
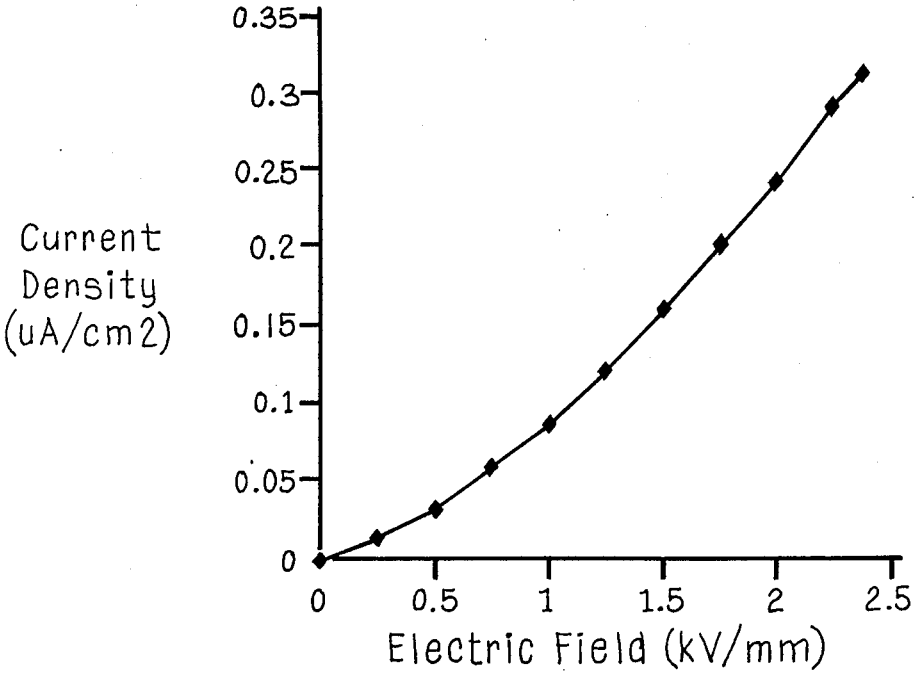
FIG. 2 is a graph plotting current density in microamps per square centimeter against the same electric field for the same fluid.

FIG. 2 shows the corresponding current density passing through the fluid of Example 1 over the same range of electric field. The observed induced yield stress (T) as a function of electric field (E) is empirically described by the following equation:

$$T=14+392E^2$$

in which the electric field is expressed in units of kilovolts per millimeter (kV/mm) and the resulting yield stress is in pascals (newtons/$m^2$).

EXAMPLE II

This fluid was prepared identically to that of Example I with the exception that the amount of dispersant was doubled. A sample of this fluid was maintained in an oven in an open container at 115° C. for 15 hours and showed no degradation in performance as determined by an ER test probe.

EXAMPLE III

This fluid comprised 100 parts of lithium hydrazinium sulfate prepared as described above and 100 parts of silicone oil. This fluid was prepared in the absence of any suspension stabilizer and had the consistency of thick axle grease. Its thickness prevented any appropriate yield stress testing.

EXAMPLE IV

This fluid was produced by adding 0.26 parts of Baysilone OF-4061 to the fluid of Example III. Upon addition of the stabilizer,.the consistency of the fluid immediately changed to that of milk. This amount of dispersant, however, was slightly more than appropriate for formation of the weekly flocculated gel. Upon standing, this fluid separated to form a small clear layer of fluid above a thick, loose, weakly flocculated sediment layer.

EXAMPLE V

This fluid was prepared in an identical manner to Example IV with the exception that only 0.1 part of Baysilone OF-4061 was added. This fluid had the consistency of milk, showed a strong electrorheological response, and did not settle to form sediment. After a standing time of about one hour, this fluid forms a thixotropic gel throughout its entire volume.

EXAMPLE VI

This fluid comprised 100 parts of lithium hydrazinium sulfate which was subjected to limited grinding and had an average particle size of about 100 microns, mixed with 100 parts of silicone oil. Although this fluid had the same absolute proportions as the fluid of Example III, it remained fluid in the absence of any dispersant because of its larger particle size. The larger particles, however, settled out rather quickly. This fluid was maintained in an open container in a convection oven at about 120° C. for about 60 hours. It displayed the same strong electrorheological response both before and after the oven treatment.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A fluid having electrorheological properties at low current densities and in the absence of absorbed water or water of hydration, said fluid comprising a suspension of:

a liquid phase formed of a dielectric liquid; and a dispersed particulate phase formed of lithium hydrazinium sulfate.

2. A fluid according to claim 1 and further comprising a block copolymer steric stabilizer having an anchor polymer selected from the group consisting of:

poly(acrylonitrile)
poly(oxyethylene)
poly(ethylene)
poly(propylene)
poly(vinyl chloride)
poly(methyl methacrylate)
poly(acrylamide)

and a stabilizing moiety selected from the group consisting of:

polystyrene
poly(lauryl methacrylate)
poly(12-hydrostearic acid)
poly(dimethylsiloxane)
poly(isobutylene)
cis-1:4-poly(isoprene)
poly(vinyl acetate)
poly(methyl methacrylate)
poly(vinyl methyl ether).

3. A fluid according to claim 1 and further comprising a steric stabilizer selected from the group consisting of:

a.

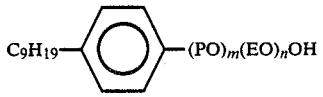

b. n-Bu$(PO)_m(EO)_nOH$ c. $HO(EO)_n(PO)_m(EO)_nOH$ d.

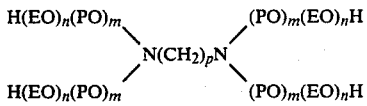

e. alkyl-phenol-formaldehyde novolac resin alkoxylate

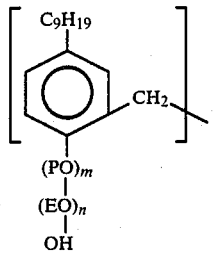

f. $(C_6H_{13}CH(OH)C_{10}H_{20}COOH)_n[H(EO)_mOH]$ poly(12-hydroxystearic acid)/polyethylene glycol copolymer g. polymethylmethacrylate-polyethylene glycol copolymer

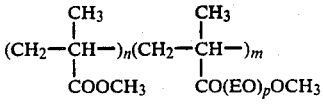

h. polyalkenylsuccinic acid-polyethylene glycol copolymer

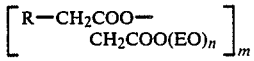

i. polyethylene glycol-alkyd resins and wherein $(PO)_m$ is poly(propylene oxide), $(EO)_n$ is poly(ethylene oxide), $(PO_m(EO)_n$ is a poly(propylene oxide)/poly(ethylene oxide) block copolymer, n-Bu is n-butyl, and R is an alkyl or alkenyl radical group.

4. A fluid according to claim 1 wherein said liquid phase and said dispersed particulate phase form a weakly flocculated suspension.

5. A fluid according to claim 1 wherein said liquid phase and said dispersed particulate phase form a thixotropic gel.

6. A fluid according to claim 1 wherein said dielectric liquid is hydrophobic.

7. A fluid according to claim 1 wherein said particulate phase of lithium hydrazinium sulfate comprises particles which are between about 1 micron and about 20 microns in diameter.

8. A fluid according to claim 1 wherein said particulate phase of lithium hydrazinium sulfate comprises particles which are between about 5 microns and about 10 microns in diameter.

9. A fluid according to claim 1 wherein the continuous liquid phase is selected from the group consisting of: silicone oils, mineral oils, transformer oils, transformer insulating fluids, paraffin oils, perfluorinated polyethers, halogenated paraffins, and halogenated aromatic liquids.

10. A fluid according to claim 1 wherein said dispersed particulate phase of lithium hydrazinium sulfate comprises a weakly flocculated suspension.

11. A fluid according to claim 1 wherein said fluid comprises a thixotropic gel.

12. A fluid according to claim 1 wherein said liquid phase comprises a silicone oil having a viscosity between about 0.65 and about 1000 centistokes.

13. A fluid according to claim 2 or claim 3 wherein said steric stabilizer is present in an amount of between about 0.05 and about 1 molecule of stabilizing agent per square nanometer of surface area of lithium hydrazinium sulfate.

14. A fluid according to claim 1 wherein said suspension stabilizing agent comprises an amino-functionalized polydimethyl siloxane.

15. A fluid according to claim 14 in which said stabilizer is present in an amount of between about 0.05 percent and 0.3 percent by weight relative to said lithium hydrazinium sulfate.

16. A fluid according to claim 1 wherein the lithium hydrazinium sulfate dispersed particulate phase is present in a volume fraction of the total fluid of between about 15 and about 50 percent.

17. A fluid according to claim 1 wherein the fluid formed by said liquid phase and said lithium hydrazinium sulfate dispersed phase has been heat treated at temperatures above 100 degrees centigrade.

18. A fluid according to claim 1 wherein said dielectric liquid comprises silicone oil and said lithium hydrazinium sulfate is present in a ratio by weight of between about 1:1 and 1.7:1, lithium hydrazinium sulfate to silicone oil.

19. A fluid having electrorheological properties at low current densities and in the absence of adsorbed water or water of hydration, said fluid comprising a suspension of:

a liquid phase formed of about 100 parts by weight of polydimethylsiloxane oil having a viscosity of about 10 centistokes; and a dispersed particulate phase formed from between about 50 and about 170 parts by weight of lithium hydrazinium sulfate.

20. A method of preparing a fluid which exhibits electrorheological properties at low current densities and in the absense of adsorbed water or water of hydration, the method comprising:

admixing particulate lithium hydrazinium sulfate crystalline material to form a suspension of lithium hydrazinium sulfate in the dielectric liquid.

21. A method according to claim 20 further comprising admixing a suspension stabilizing agent to form the suspension.

22. A method according to claim 21 further comprising maintaining the admixture at an elevated temperature for a time sufficient to form an irreversibly thixotropic gel.

23. A method according to claim 20 wherein the step of admixing a dielectric liquid comprises admixing a liquid selected form the group consisting of: silicon oils, mineral oils, transformer oils, transformer insulating fluids, paraffin oils, perfluorinated polyethers, halogenated paraffins, and halogenated aromatic liquids.

24. A method of preparing a fluid which exhibits electroroheological properties at low current desnities and in the absence of adsorbed water or water of hydration, said method comprising:

admixing liquid silicone oil and powdered lithium hydrazinium sulfate to form a suspension of the lithium hydrazinium sulfate in the silicon oil; and maintaining the admixture at a temperature of greater than 100 degrees centigrade for a time sufficient to form an irreversibly thixotropic gel.

25. A method according to claim 24 wherein the step of admixing silicone oil and lithium hydrazinium sulfate comprises admixing sufficient lithium hydrazinium sulfate to bring the volume fraction of lithium hydrazinium sulfate in the total fluid to between about 15 and about 50 percent.

26. A method according to claim 24 wherein the step of admixing suspension stabilizer comprises admixing suspension stabilizer in an amount of between about 0.05 percent and 0.3 percent by weight relative to the admixed lithium hydrazinium sulfate.

27. A method according to claim 24 further comprising the step of admixing a steric stabilizer with the silicone oil and the lithium hydrazinium sulfate, and in which the steric stabilizer comprises a block copolymer having an anchor polymer selected from the group consisting of:

poly(acrylonitrile)
poly(oxyethylene)
poly(ethylene)
poly(propylene)
poly(vinyl chloride)
poly(metyl methacrylate)
poly(acrylamide)

and a stabilizing moiety selected from the group consisting of:

polystyrene
poly(lauryl methacrylate)
poly(12-hydrostearic acid)
poly(dimethylsiloxane)
poly(isobutylene)
cis-1:4-poly(isoprene)
poly(vinyl acetate)
poly(methyl metacrylate)
poly(vinyl methyl ether).

28. A method according to claim 24 further comprising the step of admixing a steric stabilizer with the silicon oil and the lithium hydrazinium sulfate, and in which the steric stabilizer is selected from the group consisting of:

a.
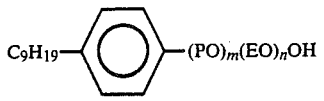
b. n-Bu$(PO)_m(EO)_n$OH
c. HO$(EO)_n(PO)_m(EO)_n$OH
d.
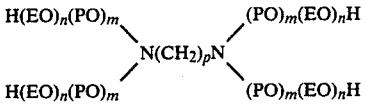
e. alkyl-phenol-formaldehyde novalac resin alkoxylate
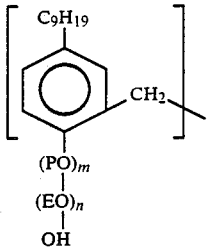
f. $(C_6H_{13}CH(OH)C_{10}H_{20}COOH)_n[H(EO)_mOH]$ poly(12-hydroxystearic acid)/polyethylene glycol copolymer
g. polymethylmethacrylate-polyethylene glycol copolymer
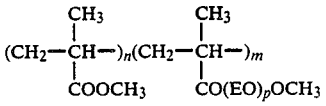
h. polyalkenylsuccinic acid-polyethylene glycol copolymer
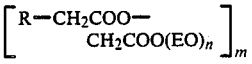
i. polyethylene glycol-alkyd resins.
* * * * *

UNITED STATES PATENT AND TRADEMARK OFFICE

CERTIFICATE OF CORRECTION

PATENT NO. : 4,772,407

DATED : September 20, 1988

INVENTOR(S) : J. David Carlson

It is certified that error appears in the above-identified patent and that said Letters Patent is hereby corrected as shown below:

Column 4, line 36, "$(H_2AlP_3O_{10}.2H_2O)$" should be --$(H_2AlP_3O_{10}\cdot 2H_2O)$--.

Column 4, line 41, "$H_2Al_3O_{10}.2H_2O$" should be --$H_2Al_3O_{10}\cdot 2H_2O$--.

Column 14, line 66, "$(PO_m(EO)_n$" should be --$(PO)_m(EO)_n$--.

Column 16, line 20, "desnities" should be --densities--.

Signed and Sealed this

Second Day of May, 1989

*Attest:*

DONALD J. QUIGG

*Attesting Officer*

*Commissioner of Patents and Trademarks*